United States Patent [19]

Molloy

[11] Patent Number: 4,733,844

[45] Date of Patent: Mar. 29, 1988

[54] SHEET ROCK SUPPORT DEVISE

[76] Inventor: John Molloy, Box 3482, Stamford, Conn. 06902

[21] Appl. No.: 13,024

[22] Filed: Feb. 10, 1987

[51] Int. Cl.[4] ..... E04G 25/00

[52] U.S. Cl. ..... 248/354.1; 414/11

[58] Field of Search ..... 248/354.1, 354.5, 354.7; 269/289 R, 310; 414/10, 11

[56] References Cited

U.S. PATENT DOCUMENTS

| | | | |
|---|---|---|---|
| 2,465,206 | 3/1949 | Davis | 414/11 |
| 2,883,073 | 4/1959 | Morris | 414/11 |
| 2,937,842 | 5/1960 | Meek | 248/354.5 |
| 2,974,931 | 3/1961 | Reel et al. | 248/354.1 X |
| 3,199,818 | 8/1965 | Ahara | 248/354.1 X |
| 3,292,892 | 12/1966 | Abbott | 248/354.7 |
| 3,307,305 | 3/1967 | Atkinson | 248/354.1 X |
| 3,365,080 | 1/1968 | Crull | 414/11 |
| 3,703,269 | 11/1972 | Meriz | 248/354.1 |
| 3,734,441 | 5/1973 | Lux | 248/354.1 |
| 3,910,421 | 10/1975 | Panneton | 414/11 |
| 3,930,645 | 1/1976 | Anderson | 414/11 X |
| 4,576,354 | 3/1986 | Blessing | 248/354.5 |

*Primary Examiner*—J. Franklin Foss

[57] ABSTRACT

A sheetrock support device is disclosed that is conveniently adjusted to heights and loads and can be operated from floor or ceiling area by a single operator. Efficiency of prior art have been greatly diminished when operating in various work areas, heights and loads. This present invention provides exact tension to supported materials eliminating damage to them by possessing easy fine adjustment capabilities.

7 Claims, 4 Drawing Figures

SHEET ROCK SUPPORT DEVISE

BACKGROUND OF THE INVENTION

1. Field of Invention

This invention relates to sheetrock support that is conveniently adjustable to various working areas, heights and loads.

2. Description of Prior Art

One prior art device used for supporting sheetrock to be nailed to ceiling beams contains an operation of reloading sheetrock by pulling down platform against an already compressed support spring and clutch friction spring, to allow space for the next sheet. Then sheetrock is raised by two operators almost to ceiling, and made ready to be spring launched to ceiling. The problem with this spring launching is its tendancy to damage the lighter materials as it is slammed against the ceiling under the main body battering force of the device, which is sprung with the sheetrock.

This rigid platform structure and base makes it difficult to make final adjustments to sheetrock and often requires pulling down against loaded springs a second time and often a third time. Note* Friction clutch is used only to keep table or platform in the down or collapsed position. It cannot be used to hold the sheetrock in the up position.

The value and efficiency of prior art have been greatly diminished when adapting to varied working areas, heights and loads.

It would be of great value to the art to provide a support device light enough in weight to be easily adjusted to heights and desired pressures in one step. It would be of great value to the art also to eliminate any rigid base and platform to reduce weight and attain maximum ease of maneuverability.

SUMMARY OF THE INVENTION

It is the object of this invention to provide a support for sheetrock that can handle equally well wide varations in ceiling heights, sizes and weights of sheetrock and be operated from floor, stilts, scaffold or step ladder with equal ease.

It is also an object of this invention that when set in close proximity, it can be easily released and moved to support position by an operator using one hand.

DESCRIPTION OF THE PREFERRED EMBODIMENT

Figure 1:
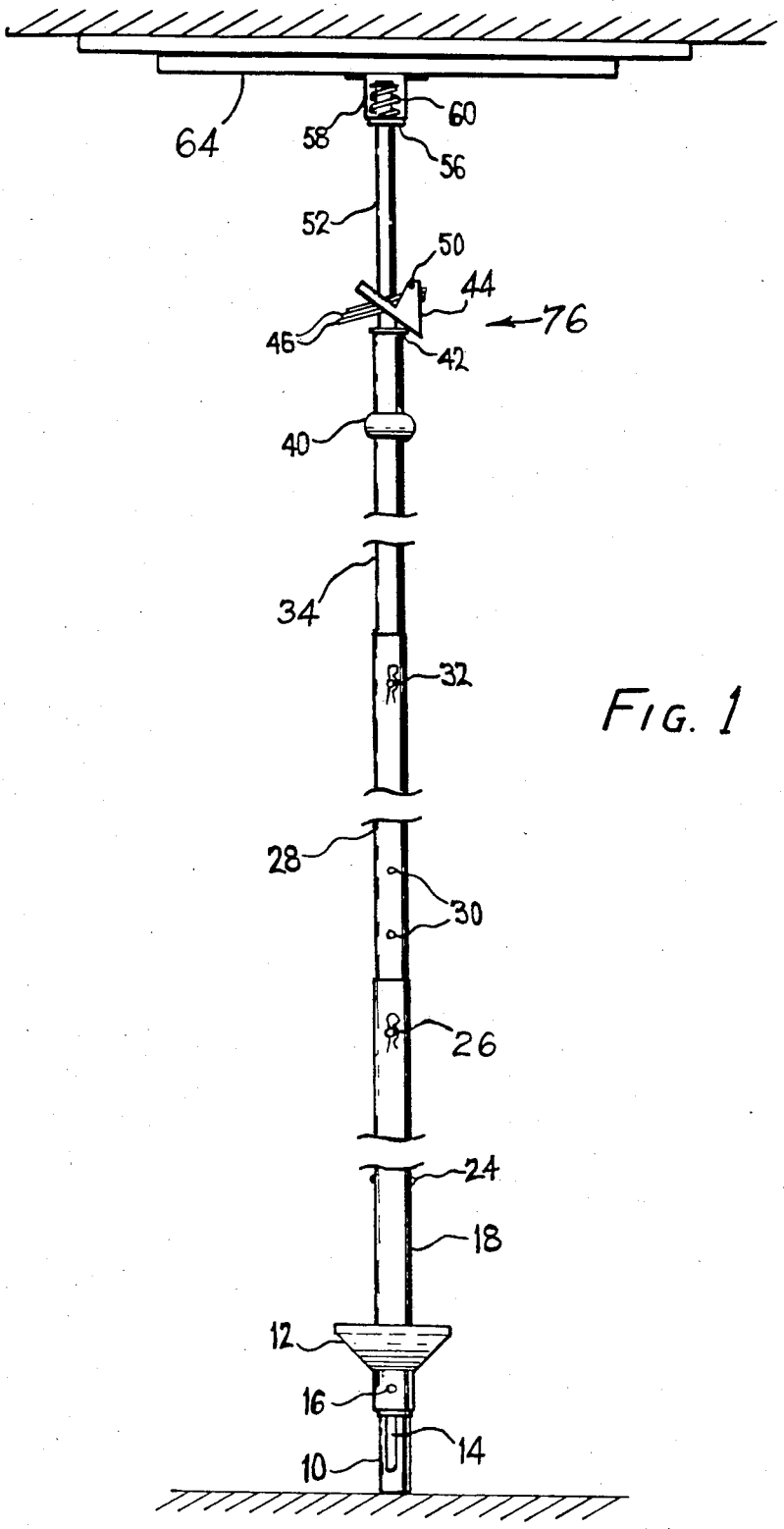
FIG. 1 is an elevational drawing of a sheetrock support device constructed in accordance with the invention.

Referring to FIG. 1, a sheetrock support device in accordance with the invention, pin 16 fastens foot compression step lever 12 to lower support tube 18 and also acts as stop and guide for spring support tube 10 along slot 14.

Figure 4:
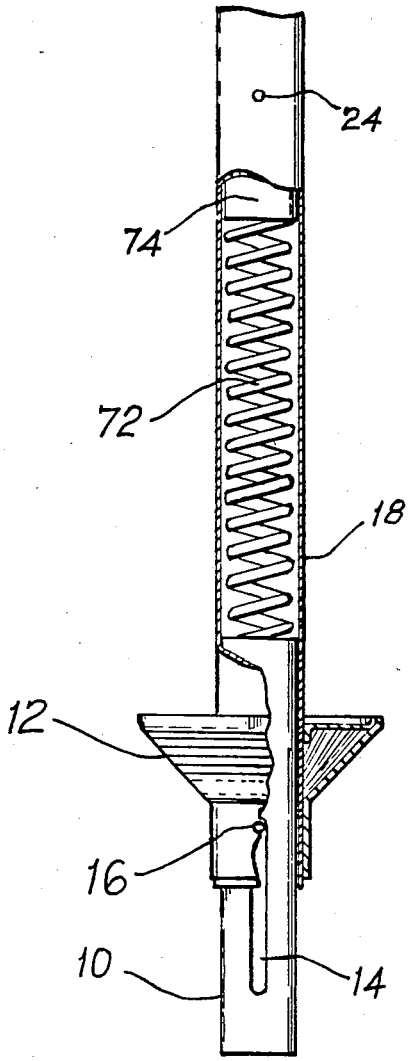
FIG. 4. is an elevational and cross-section view of the lower portion of FIG. 1.

Referring to FIG. 4, Compression spring 72 bears to spring stop 74 which is fastened to lower support tube 18 by retaining pin 24.

Referring back to FIG. 1, lower support tube member 18 is received by middle support tube 28 and is connected by adjusting stages 30, by pin and clevis 26. Middle support tube member 28 is received by upper support tube 34 and is connected by pin and clevis 32.

Figure 2:
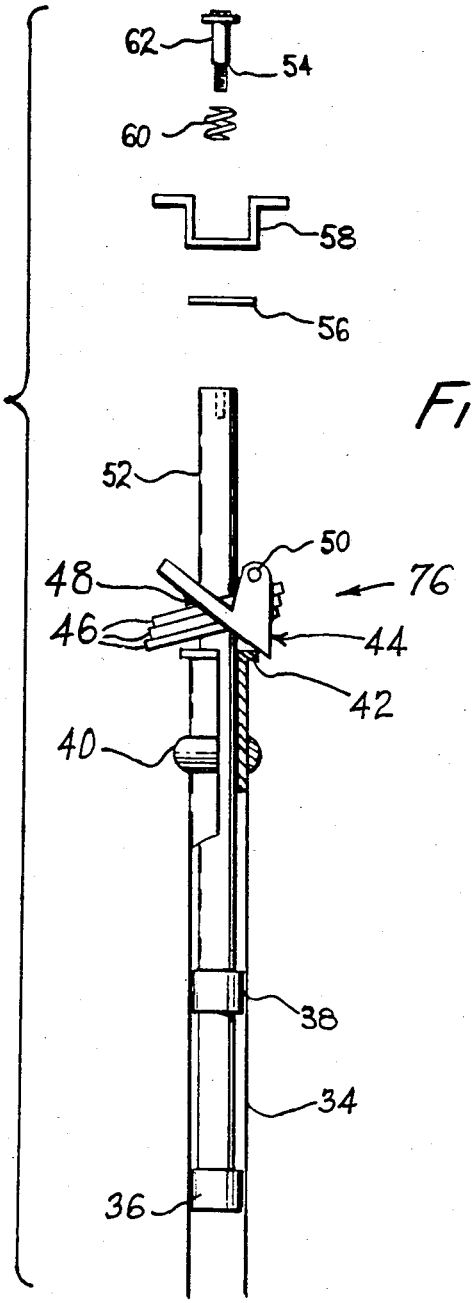
FIG. 2 is a sectional, exploded view of the upper portion of FIG. 1.
Figure 3:
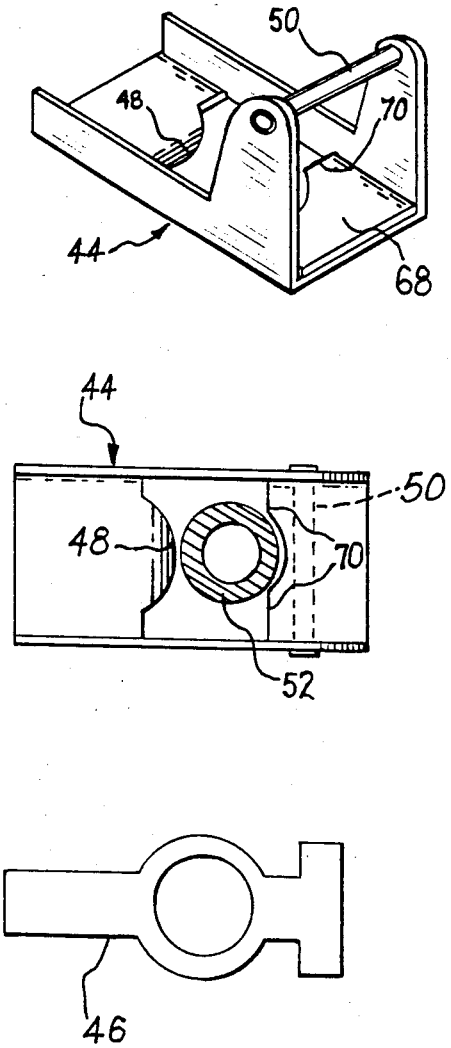
FIG. 3. is an exploded and isometric view of the springless friction-clutch.

Referring to FIG. 2, hand piece 40 is used for pushing down on main support column of 18, 28, and 34 and compresses support spring 72 of FIG. 4, while height adjusting rod 52 is being raised up. Clutch 76 slides down and bears on flanged bushing 42. Friction clutch lever 44 clamps clutch pieces 46 together and binds them between friction clutch levers bearing points 48 and 70 of FIG. 3. Pin 50 bears on and keeps level pieces 46 together and binds them between friction clutch levers bearing points 48 and 70 of FIG. 3. Pin 50 bears on and keeps level piece 46 when sliding down adjusting support member 52. Adjusting support member 52 is guided by flanged bushing 42, stops 38 and guides 36, in upper support tube 34.

Shoulder bolt 62 goes through spring 60 and bracket 58 and shoulders on bracket support 56 and is torqued into support rod 52, on which platform 64 is mounted.

What is claimed is:

1. A temporary support device for use in installing an overhead sheetrock panel for aiding the installer in positioning and attaching a sheetrock panel to overhead structure, said temporary support device comprising:

a horizontally extending platform element upon which a panel of sheetrock can be supported temporarily, an elongated support rod adapted for being positioned generally vertically and having upper and lower ends, resilient connection means connecting said horizontally extending platform element in generally perpendicular relationship to said upper end of said elongated support rod for permitting said elongated support rod to be tilted somewhat away from vertical while said horizontally extending platform element remains horizontal, a tubular support column having top and bottom ends, said lower end of said elongated support rod being received in said top end of said tubular support column in telescoping relationship therein for permitting said elongated support rod to be moved upwardly and downwardly relative to said tubular support column, a manually releasable one-way friction clutch assembly carried by said tubular support column and frictionally engageable with said elongated support rod for allowing said elongated support rod to be moved freely upwardly for extending said elongated support rod upwardly relative to said tubular support column while normally frictionally gripping said elongated support rod for preventing said elongated support rod from moving downwardly relative to said tubular support column, a vertically elongated, floor-engaging member adapted to rest upon a floor, said vertically elongated, floor-engaging member being in telescoping relationship with said bottom end of said tubular support column for permitting said bottom end of said tubular support column to be moved upwardly and downwardly relative to said floor-engaging member, a compression spring having first and second ends, said first end of said compression spring being seated down against said floor-engaging member for thrusting downwardly upon said floor-engaging member, and said second end of said compression spring being seated up against said tubular support column for thrusting upwardly upon said tubular support column, whereby an installer of overhead sheetrock can place a panel of sheetrock up against the overhead structure and then while holding said panel up against said overhead structure with a first hand can use a second hand to grasp said temporary device for positioning said floor-engaging member in a suitable position below said panel and then can use said second hand to exert a thrust upwardly on said elongated support rod to position and place said horizontally extending platform element up against the panel for temporarily supporting the panel and while holding said horizontally extending platform element up against the panel with said second hand, can now release said first hand from holding said panel for now grasping said tubular support column with said first hand for thrusting downwardly on said tubular support column for compressing said compression spring, whereupon releasing both of said installer's hands allows the compressed compression spring simultaneously to thrust down upon said floor-engaging member and to thrust upwardly upon said tubular support column for causing said friction clutch assembly to be in friction gripping relationship with said elongated support rod for transmitting the upward thrust of the compressed compression spring through said elongated support rod to said horizontally extending platform element for applying the upward thrust of the compressed compression spring through said horizontally extending platform element to the sheetrock panel for temporarily holding and pressing the sheetrock panel up against the overhead structure until said friction clutch assembly is manually released.

2. A temporary structure device for use in installing an overhead sheetrock panel as claimed in claim 1, in which:

said friction clutch assembly includes a plurality of similar clutch pieces each having a hole therein slightly larger than the diameter of said elongated support rod, said clutch pieces being stacked on top of each other forming an uppermost and lowermost clutch piece with said elongated support rod extending through the holes in said clutch pieces, a clutch lever having a first bearing point positioned above said uppermost clutch piece for bearing down upon said uppermost clutch piece on one side of said elongated support rod and said clutch lever having at least a second bearing point located on the opposite side of said elongated support rod from said first bearing point, said second bearing point being positioned below said lowermost clutch piece for bearing up against said lowermost clutch piece, said clutch lever being carried by said tubular support column by resting down upon the top end of said tubular support column for causing said second bearing point to bear upwardly against said lowermost clutch piece on said opposite side of said elongated support rod while said first bearing point is simultaneously bearing down upon said uppermost clutch piece on said one side of said elongated support rod for causing said clutch pieces to become inclined into friction gripping relationship with said elongated support rod for preventing said elongated support rod from moving downwardly relative to said tubular support column, whereby said friction clutch assembly is manually releasable by manually lifting said first bearing point off of said uppermost clutch piece while manually thrusting down on said tubular support column.

3. A temporary support device for use in installing an overhead sheetrock panel as claimed in claim 1, in which:

said tubular support column has a foot step secured thereon near said bottom end of said tubular support column for enabling the installer to press down on said foot step with one foot for aiding said first hand in thrusting down on said tubular support column for compressing said compression spring.

4. A temporary support device for use in installing an overhead sheetrock panel as claimed in claim 2, in which:

said tubular support column has a foot step secured thereon near said bottom end of said tubular support column for enabling the installer to press down on said foot step with one foot for aiding said first hand in thrusting down on said tubular support column for compressing said compression spring.

5. A temporary support device for use in installing an overhead sheetrock panel as claimed in claim 2, in which:

said top end of said tubular support column includes a flanged bushing having a radially extending flange with a circumferential rim, and said clutch lever is carried by the top end of said tubular support column by resting down on said circumferential rim of said radial flange.

6. A temporary support device for use in installing an overhead sheetrock panel as claimed in claim 1, in which:

said top end of said tubular support column includes a rounded convex hand piece used for grasping by an installer's hand for thrusting down on said tubular support column for compressing said compression spring.

7. A temporary support device for use in installing an overhead panel of sheetrock as claimed in claim 1, in which:

said tubular support column comprises a plurality of interconnecting tubular members releasably interconnected for enabling said tubular support column to be adjusted in length and disassembled for convenient storage.

* * * * *